US011279551B2

(12) United States Patent
Tsuchiya et al.

(10) Patent No.: US 11,279,551 B2
(45) Date of Patent: Mar. 22, 2022

(54) PACKING UNIT FOR AIR-CONDITIONING APPARATUS

(71) Applicant: Mitsubishi Electric Corporation, Tokyo (JP)

(72) Inventors: Hiroki Tsuchiya, Tokyo (JP); Koji Sachimoto, Tokyo (JP); Yohei Kawaguchi, Tokyo (JP); Yusuke Mukai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/976,551

(22) PCT Filed: Apr. 12, 2018

(86) PCT No.: PCT/JP2018/015428
§ 371 (c)(1),
(2) Date: Aug. 28, 2020

(87) PCT Pub. No.: WO2019/198209
PCT Pub. Date: Oct. 17, 2019

(65) Prior Publication Data

US 2021/0061546 A1 Mar. 4, 2021

(51) Int. Cl.
*B65D 85/68* (2006.01)
*B65D 81/05* (2006.01)

(52) U.S. Cl.
CPC ..... *B65D 85/68* (2013.01); *B65D 81/05* (2013.01); *B65D 2585/6882* (2013.01)

(58) Field of Classification Search
CPC . B65D 85/68; B65D 81/05; B65D 2585/6875
(Continued)

(56) References Cited

U.S. PATENT DOCUMENTS 5,143,283 A * 9/1992 Lancaster ..... B65D 5/445 206/320
5,743,393 A * 4/1998 Webb ..... B65D 85/68 206/319

(Continued)

FOREIGN PATENT DOCUMENTS

DE 8020704 U1 11/1980
JP H06-329173 A 11/1994

(Continued)

OTHER PUBLICATIONS

Office Action dated Sep. 1, 2021 issued in corresponding CN patent application No. 201880092154.4 (and English translation).

(Continued)

*Primary Examiner* — Jacob K Ackun
(74) *Attorney, Agent, or Firm* — Posz Law Group, PLC

(57) ABSTRACT

A packing unit for an air-conditioning apparatus includes an outdoor unit with heavy objects that are provided on a bottom plate of a housing of the outdoor unit. On the packing unit, the outdoor unit is placed. The packing unit includes: a support base that has a cuboid framework structure made by combining a plurality of wood pieces, and supports the outdoor unit; a long wood piece that has a long plate shape, and that forms part of an upper surface portion of the support base and faces the bottom plate, the long wood piece having end portions, one of the end portions being fixed to the support base, the other being a free end that is movable in a vertical direction; and a support wood piece that is provided on an upper surface portion of the end portion on a free end side of the long wood piece.

7 Claims, 6 Drawing Sheets

(58) Field of Classification Search
USPC ..... 206/319, 320
See application file for complete search history.

(56) References Cited

U.S. PATENT DOCUMENTS

| | | | | |
|---|---|---|---|---|
| 10,174,956 | B2 * | 1/2019 | Stanton | B65D 7/14 |
| 2006/0222542 | A1 * | 10/2006 | Hara | B65D 85/68 417/572 |
| 2018/0134440 | A1 * | 5/2018 | Unno | B65D 5/02 |

FOREIGN PATENT DOCUMENTS

| | | | |
|---|---|---|---|
| JP | 2003-144278 | A | 5/2003 |
| JP | 2005-219790 | A | 8/2005 |
| JP | 2005-271958 | A | 10/2005 |
| JP | 2015-107805 | A | 6/2015 |
| JP | 2015-205704 | A | 11/2015 |
| JP | 2017-083029 | A | 5/2017 |

OTHER PUBLICATIONS

International Search Report of the International Searching Authority dated May 29, 2018 for the corresponding International application No. PCT/JP2018/015428 (and English translation).
Office Action dated Jun. 22, 2021 issued in corresponding JP patent application No. 2020-513023 (and English translation).
Extended European Search Report dated Mar. 9, 2021, issued in corresponding European Patent Application No. 18914920.6.

* cited by examiner

Comparative Example

Comparative Example

Comparative Example

Comparative Example

PACKING UNIT FOR AIR-CONDITIONING APPARATUS

CROSS REFERENCE TO RELATED APPLICATION

This application is a U.S. national stage application of PCT/JP2018/015428 filed on Apr. 12, 2018, the contents of which are incorporated herein by reference.

TECHNICAL FIELD

The present disclosure relates to a packing unit, and more particularly, to a structure of a packing unit for an air-conditioning apparatus, which is made to reduce an impact that is applied to the air-conditioning apparatus when the air-conditioning apparatus drops.

BACKGROUND ART

In order to prevent an air-conditioning apparatus being broken even if the air-conditioning apparatus drops when being shipped and transported to an installation site, a packing unit is attached under the air-conditioning apparatus. Therefore, even if the air-conditioning apparatus drops, an impact on the air-conditioning apparatus at that time is reduced by the packing unit. In general, the packing unit, which is set under the air-conditioning apparatus, is made of wood pieces and polystyrene foam, or cardboard and polystyrene foam, or wood pieces only. In an existing and proposed packing unit, polystyrene foam is inserted between wood pieces of the packing unit at a position located immediately under the center of gravity of the air-conditioning apparatus, to thereby reduce an impact that is applied to an air-conditioning apparatus when the air-conditioning apparatus drops (see, for example, Patent Literature 1). Also, another proposed packing unit is made to include a wood piece that is bent and fixed to an air-conditioning apparatus, and to thus have an elastic force, in order to reduce an impact that is applied to the air-conditioning apparatus when the air-conditioning apparatus drops (see, for example, Patent Literature 2).

CITATION LIST

Patent Literature

Patent Literature 1: Japanese Unexamined Patent Application Publication No. 6-329173

Patent Literature 2: Japanese Unexamined Patent Application Publication No. 2015-205704

SUMMARY OF INVENTION

Technical Problem

In the case where polystyrene foam is used as the material of a packing unit that is provided directly under an air-conditioning apparatus, and the air-conditioning apparatus is made to incorporate two or more fans and have a greater weight and larger diameters such that the total weight of components in the air-conditioning apparatus is greater, since polystyrene foam has a low stiffness, it is more highly possible that the packing unit cannot support the loads of the components when the air-conditioning apparatus drops during transportation and installation, and a bottom plate of a housing that is located immediately under the components will be bent and broken by an impact that is applied to the air-conditioning apparatus when the air-conditioning apparatus drops. It is therefore necessary to use, as the material of the packing unit, a material having a higher stiffness than polystyrene foam, and it is conceivable to use, as such a material, wood pieces, for example. However, when a material having a high stiffness is applied to the packing unit, an impact force that is applied from a floor when the air-conditioning apparatus drops onto the floor is easily transmitted to the air-conditioning apparatus, as a result of which the air-conditioning apparatus is damaged or broken.

The present disclosure is applied to solve the above problems, and relates to a packing unit for an air-conditioning apparatus, which employs wood pieces to absorb an impact that is applied when the air-conditioning apparatus drops, which has a proof stress enough to prevent the air-conditioning apparatus from being broken by the load of the air-conditioning apparatus when the air-conditioning apparatus drops, and also which prevents an impact force that is applied from a floor when the air-conditioning apparatus drops onto the floor from being easily transmitted to the air-conditioning apparatus.

Solution to Problem

A packing unit according to an embodiment of the present disclosure is provided for an air-conditioning apparatus provided with an outdoor unit including heavy objects that are provided on a bottom plate of a housing of the outdoor unit. On the packing unit, the outdoor unit is placed. The packing unit includes: a support base that has a cuboid framework structure made by combining a plurality of wood pieces, and supports the outdoor unit when the outdoor unit is placed on the support base; a long wood piece that has a long plate shape, and that forms part of an upper surface portion of the support base and faces the bottom plate, the long wood piece having end portions, one of the end portions being fixed to the support base, the other being a free end that is movable in a vertical direction; and a support wood piece that is provided on an upper surface portion of the end portion on a free end side of the long wood piece, and that is located under the heavy objects and contact the bottom plate when the outdoor unit is placed on the support base.

Advantageous Effects of Invention

The packing unit for an air-conditioning apparatus according to the embodiment of the present disclosure includes the long wood piece that has a long plate shape, and that forms part of the upper surface portion of the support base and faces the bottom plate. One end portion of the long wood piece is fixed to the support base, and the other end portion of the long wood piece is a free end that is movable in the vertical direction. The support wood piece is provided on the upper surface portion of the end portion on a free end side of the long wood piece, and is located under the heavy objects and contacts the bottom plate when the outdoor unit is placed on the support base. Therefore, the packing unit is formed to make use of an elastic force of wood having a higher stiffness than polystyrene foam, and supports the load of the heavy objects when the air-conditioning apparatus drops, and absorbs an impact that is applied when the air-conditioning apparatus drops, and has a proof stress enough to prevent the air-conditioning apparatus from being broken by a load that acts on the air-conditioning apparatus when the air-conditioning apparatus drops, Therefore, because of attachment of the packing unit to the air-conditioning apparatus, an impact force that is applied from a floor when the air-conditioning apparatus drops to the floor is not easily transmitted to the air-conditioning apparatus, and an impact on the air-conditioning apparatus at that time can be reduced, and the air-conditioning apparatus can be prevented from being broken.

DESCRIPTION OF EMBODIMENTS

Figure 1:
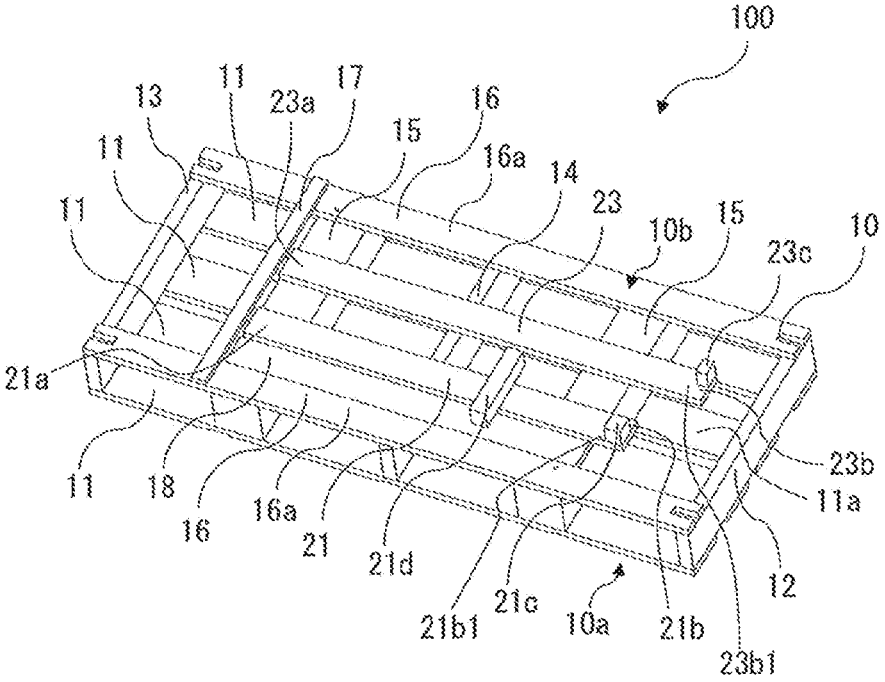
FIG. 1 is a perspective view of a packing unit according to Embodiment 1 of the present disclosure.

A packing unit 100 and a packing unit 110 according to embodiments of the present disclosure for an air-conditioning apparatus 200 will be described with reference to the drawings. In the following figures, components that are the same as or equivalent to those in a previous figure are denoted by the same reference signs. The same is true of the entire text of the descriptions of the embodiments described below. Forms of elements described in the entire specification are merely examples, and are not limited to the forms described in the specification. Furthermore, in the drawings, a relationship in size between elements may be different from an actual one. With respect to the embodiments, in order that they be easily understood, terms related to directions (such as "upper", "lower", "right", "left", "front", and "rear") are used as appropriate. However, these terms are used only for explanation, that is, they do not limit the embodiments.

<Structure of Packing Unit 100>

Figure 2:
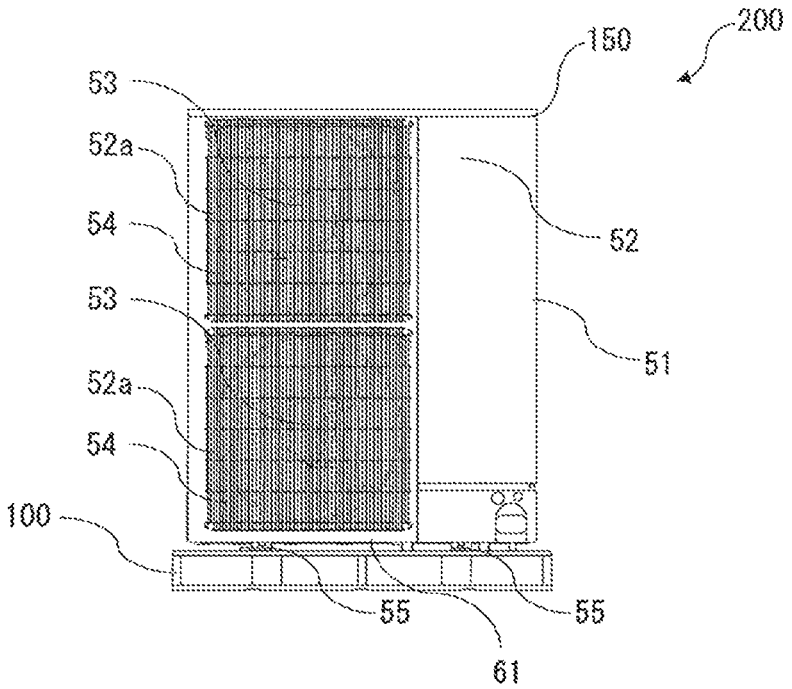
FIG. 2 is an external view of the packing unit according to Embodiment 1 of the present disclosure, which is attached to an outdoor unit of an air-conditioning apparatus.

FIG. 1 is a perspective view of a packing unit 100 according to Embodiment 1 of the present disclosure. FIG. 2 is an external view of the packing unit 100 according to Embodiment 1 of the present disclosure, which is attached to an outdoor unit 150 of an air-conditioning apparatus 200. A structure of the packing unit 100 will be described with reference to FIGS. 1 and 2. The packing unit 100 is a unit at which the air-conditioning apparatus 200 is packed, and the outdoor unit 150 in which heavy objects are provided on a bottom plate 61 of a housing 51 is placed on the packing unit 100. The packing unit 100 includes a support base 10 having an upper surface portion 10*b* on which the outdoor unit 150 is placed. Furthermore, the packing unit 100 includes a first long wood piece 21 having a long plate shape and forming part of the upper surface portion 10*b* of the support base 10 that faces the bottom plate 61 of the outdoor unit 150. The first long wood piece 21 has one end portion 21*a* fixed to the support base 10 and the other end portion 21*b* that is a free end movable in a vertical direction. Furthermore, the packing unit 100 includes a second long wood piece 23 having a long plate shape and forming part of the upper surface portion 10*b* of the support base 10 that faces the bottom plate 61 of the outdoor unit 150. The second long wood piece 23 has one end portion 23*a* fixed to the support base 10 and the other end portion 23*b* that is a free end movable in the vertical direction. The packing unit 100 also includes a first support wood piece 21*c* that is provided on an upper surface portion 21*b*1 of the end portion 21*b* on a free end side of the first long wood piece 21, and that is located under a heavy object and contacts the bottom plate 61 when the outdoor unit 150 is placed on the support base 10. Furthermore, the packing unit 100 includes a second support wood piece 23*c* that is provided on an upper surface portion 23*b*1 of the end portion 23*b* on a free end side of the second long wood piece 23, and that is located under a heavy object and contacts the bottom plate 61 when the outdoor unit 150 is placed on the support base 10.

(Support Base 10)

The support base 10 is a cuboid framework structure formed by combining a plurality of wood pieces. The support base 10 includes, at a bottom portion 10*a*, a plurality of bottom-plate wood pieces 11 each of which is formed in the shape of a long rectangular plate. As viewed in plan view from an upper position located above in a direction perpendicular to the bottom-plate wood pieces 11, the bottom-plate wood pieces 11 are arranged at regular intervals in the width direction of the bottom-plate wood pieces 11 in the same plane such that the bottom-plate wood pieces 11 extend parallel to each other in the longitudinal direction of the bottom-plate wood pieces 11. Furthermore, the bottom-plate wood pieces 11 are provided such that corresponding side surfaces thereof face in the same direction. One end portion of each bottom-plate wood piece 11 in the longitudinal direction thereof is fixed to a right plate wood piece 12, and the other end portion of each bottom-plate wood piece 11 in the longitudinal direction is fixed to a left plate wood piece 13.

The support base 10 includes the right plate wood piece 12 and the left plate wood piece 13 on upper portions of the bottom-plate wood pieces 11. The right plate wood piece 12 and the left plate wood piece 13 are pieces of long rectangular lumber, and are fixed to upper surface portions 11*a* of the bottom-plate wood pieces 11 at the end portions of the bottom-plate wood pieces 11 on both sides of each bottom-plate wood piece 11 in the longitudinal direction. The right plate wood piece 12 and the left plate wood piece 13 are fixed to the bottom-plate wood pieces 11 in such a manner as to extend over the bottom-plate wood pieces 11, thereby connecting the bottom-plate wood pieces 11. As view in plan view from the upper position located above in the direction perpendicular to the bottom-plate wood pieces 11, the right plate wood piece 12 and the left plate wood piece 13 are provided such that the longitudinal direction of the right plate wood piece 12 and the left plate wood piece 13 is parallel to the width direction of the bottom-plate wood pieces 11. Furthermore, the right plate wood piece 12 and the left plate wood piece 13 are arranged parallel to each other.

The support base 10 further includes a center wood piece 14 on the upper portions of the bottom-plate wood pieces 11, and the center wood piece 14 is provided to extend parallel to the right plate wood piece 12 and the left plate wood piece 13. The center wood piece 14 is a piece of long rectangular lumber, fixed to the upper surface portions 11*a* of the bottom-plate wood pieces 11, is located between the right plate wood piece 12 and the left plate wood piece 13. The center wood piece 14 is provided substantially at centers of the bottom-plate wood pieces 11 in the longitudinal direction thereof. The center wood piece 14 is fixed to the upper surface portion 11*a* of each of the bottom-plate wood pieces 11 that are arranged side by side with one another. The center wood piece 14 is fixed to the bottom-plate wood pieces 11 in such a manner as to extend over the bottom-plate wood pieces 11, thereby connecting the bottom-plate wood pieces 11. As viewed in plan view from the upper position located above in the direction perpendicular to the bottom-plate wood pieces 11, the center wood piece 14 is provided such the longitudinal direction of the center wood piece 14 is parallel to the width direction of the bottom-plate wood pieces 11. Furthermore, the center wood piece 14 is provided to extend parallel to the right plate wood piece 12 and the left plate wood piece 13.

The support base 10 further includes middle wood pieces 15 on upper portions of the bottom-plate wood pieces 11, and the middle wood pieces 15 is provided parallel to the right plate wood piece 12, the left plate wood piece 13, and the center wood piece 14. One of the middle wood pieces 15 is located between the right plate wood piece 12 and the center wood piece 14, and the other middle wood piece 15 is located between the left plate wood piece 13 and the center wood piece 14. The middle wood pieces 15 are pieces of long rectangular lumber, and are each fixed to the upper surface portions 11*a* of the bottom-plate wood pieces 11 that are side by side with one another. The middle wood pieces 15 are fixed to the bottom-plate wood pieces 11 in such a manner as to extend over the bottom-plate wood pieces 11, thereby connecting the bottom-plate wood pieces 11. As viewed in plan view from the upper position located above in the direction perpendicular to the bottom-plate wood pieces 11, the middle wood pieces 15 are provided such that the longitudinal direction of the middle wood pieces 15 are parallel to the width direction of the bottom-plate wood pieces 11. Furthermore, the middle wood pieces 15 are provided parallel to the right plate wood piece 12, the left plate wood piece 13, and the center wood piece 14. The right plate wood piece 12, the left plate wood piece 13, the center wood piece 14, and the middle wood pieces 15 have the same length in the longitudinal direction. The support base 10 includes upper wood pieces 16 on upper portions of the right plate wood piece 12, the left plate wood piece 13, the center wood piece 14, and the middle wood pieces 15. Between the upper wood pieces 16 and the bottom-plate wood pieces 11, the right plate wood piece 12, the left plate wood piece 13, the center wood piece 14, and the middle wood pieces 15 have the same height. That is, upper surfaces of the right plate wood piece 12, the left plate wood piece 13, the center wood piece 14, and the middle wood pieces 15 are located in the same plane, and also lower surfaces of the right plate wood piece 12, the left plate wood piece 13, the center wood piece 14, and the middle wood pieces 15 are located in the same plane. The center wood piece 14 and the middle wood pieces 15 are provided to strengthen the support base 10.

The upper wood pieces 16 are plate material at which leg portions 55 provided on the bottom plate 61 are placed when the outdoor unit 150 is placed on the support base 10. The right plate wood piece 12, the left plate wood piece 13, the center wood piece 14, and the middle wood pieces 15 are fixed to the upper wood pieces 16, at both end portions of the right plate wood piece 12, the left plate wood piece 13, the center wood piece 14, and the middle wood pieces 15 in the longitudinal direction thereof. The upper wood pieces 16 extend over upper surface portions of the right plate wood piece 12, the left plate wood piece 13, the center wood piece 14, and the middle wood pieces 15. The upper wood pieces 16 are fixed to the right plate wood piece 12, the left plate wood piece 13, the center wood piece 14, and the middle wood pieces 15 in such a manner as to extend over the right plate wood piece 12, the left plate wood piece 13, the center wood piece 14, and the middle wood pieces 15, thereby connecting the right plate wood piece 12, the left plate wood piece 13, the center wood piece 14, and the middle wood pieces 15. The upper wood pieces 16 are each formed in the shape of a long rectangular plate, and as viewed in plan view from the upper position located above in the direction perpendicular to the bottom-plate wood pieces 11, the upper wood pieces 16 are provided such that the longitudinal direction of the upper wood pieces 16 is parallel to the width direction of the right plate wood piece 12, the left plate wood piece 13, the center wood piece 14, and the middle wood pieces 15. Furthermore, the upper wood pieces 16 that are provided on the above both end portions of the right plate wood piece 12, the left plate wood piece 13, the center wood piece 14, and the middle wood pieces 15 in the longitudinal direction thereof are provided to extend parallel to each other. Also, the upper wood pieces 16 are provided such that lower surface portions of the upper wood pieces 16 face the upper surface portions of the bottom-plate wood pieces 11. That is, as the support base 10 is viewed side-on, the upper wood pieces 16 are provided to extend parallel to the bottom-plate wood pieces 11, with the right plate wood piece d12, the left plate wood piece 13, the center wood piece 14, and the middle wood pieces 15 interposed between the upper wood pieces 16 and the bottom-plate wood pieces 11 Thus, a plane in which the upper wood pieces 16 are located is parallel to a plane in which the bottom-plate wood pieces 11 are located. That is, the right plate wood piece 12, the left plate wood piece 13, the center wood piece 14, and the middle wood pieces 15 are provided between the bottom-plate wood pieces 11 and the upper wood pieces 16. Furthermore, the bottom-plate wood pieces 11 are each fixed to lower surface portions of the right plate wood piece 12, the left plate wood piece 13, the center wood piece 14, and the middle wood pieces 15.

The support base 10 includes a positioning wood piece 17 that is provided to extend between the upper wood pieces 16. The positioning wood piece 17 contacts the leg portions 55 of the outdoor unit 150 that is placed on the upper wood pieces 16, whereby the outdoor unit 150 on the support base 10 is positioned. The positioning wood piece 17 is formed in the shape of a long rectangular plate, and is fixed to upper surface portions 16*a* of the two upper wood pieces 16. As viewed in plan view from the upper position located above in the direction perpendicular to the bottom-plate wood pieces 11, the positioning wood piece 17 is provided such that the longitudinal direction of the positioning wood piece 17 is parallel to the longitudinal directions of the right plate wood piece 12, the left plate wood piece 13, the center wood piece 14, and the middle wood pieces 15. Furthermore, as viewed in plan view from the upper position located above in the direction perpendicular to the bottom-plate wood pieces 11, the positioning wood piece 17 is located between the left plate wood piece 13 and the middle wood piece 15 located between the center wood piece 14 and the left plate wood piece 13. The positioning wood piece 17 is provided on the upper surface portions 16*a* of the upper wood pieces 16, and thus forms a protruding portion that protrudes upwardly from the upper wood pieces 16. When the leg portions 55 of the outdoor unit 150 are brought into contact with a side surface of the protruding portion, movement of the leg portions 55 on the upper wood pieces 16 in a lateral direction of the outdoor unit 150 is restricted, and the leg portions 55 on the upper wood pieces 16 are thus positioned.

The support base 10 includes a crossing wood piece 18 that is provided to extend over upper surface portions of the two middle wood pieces 15 and the center wood piece 14. The crossing wood piece 18 is fixed to the upper surface portions of the two middle wood pieces 15 and the center wood piece 14. The crossing wood piece 18 is formed in the shape of a long rectangular plate, and as viewed in plan view from the upper position located above in the direction perpendicular to the bottom-plate wood pieces 11, the crossing wood piece 18 is provided such that the longitudinal direction of the crossing wood piece 18 is parallel to the longitudinal directions of the bottom-plate wood pieces 11 and the upper wood pieces 16. Furthermore, the crossing wood piece 18 is located between the two upper wood pieces 16 and extends along one of the upper wood pieces 16.

(First Long Wood Piece 21 and Second Long Wood Piece 23)

The first long wood piece 21 is fixed to the upper surface portions of the two middle wood pieces 15 and the center wood piece 14. The first long wood piece 21 extends over the upper surface portions of the two middle wood pieces 15 and the center wood piece 14. The first long wood piece 21 is formed in the shape of a long rectangular plate, and as viewed in plan view from the upper position located above in the direction perpendicular to the bottom-plate wood pieces 11, the first long wood piece 21 is provided such that the longitudinal direction of the first long wood piece 21 is parallel to the longitudinal directions of the bottom-plate wood pieces 11 and the upper wood pieces 16. Furthermore, as viewed in plan view from the upper position located above in the direction perpendicular to the bottom-plate wood pieces 11, the first long wood piece 21 is located between the two upper wood pieces 16. The one end portion 21*a* of the first long wood piece 21 is fixed to the middle wood piece 15 located between the center wood piece 14 and the left plate wood piece 13. The other end portion 21*b* side of the first long wood piece 21 protrudes from the middle wood piece 15 located between the center wood piece 14 and the left plate wood piece 13, toward the right plate wood piece 12. That is, as viewed in plan view from the upper position located above in the direction perpendicular to the bottom-plate wood pieces 11, the end portion 21*b* of the first long wood piece 21 is a free end located between the above middle wood piece 15 and the right plate wood piece 12. The end portion 21*b* of the first long wood piece 21 is movable in the vertical direction. The first long wood piece 21 forms part of the upper surface portion 10*b* of the support base 10 and faces the bottom plate 61 of the outdoor unit 150.

A center support wood piece 21*d* is fixed to upper surface portions of the first long wood piece 21 and the crossing wood piece 18. The center support wood piece 21*d* extends over the upper surface portions of the first long wood piece 21 and the crossing wood piece 18. The center support wood piece 21*d* is a piece of long rectangular lumber, and as viewed in plan view from the upper position located above in the direction perpendicular to the bottom-plate wood pieces 11, the center support wood piece 21*d* is provided such that the longitudinal direction of the center support wood piece 21*d* is parallel to the longitudinal directions of the right plate wood piece 12, the left plate wood piece 13, the center wood piece 14, and the middle wood pieces 15. When the outdoor unit 150 is placed on the packing unit 100, the center support wood piece 21*d* contacts the bottom plate 61 of the outdoor unit 150.

The second long wood piece 23 is also fixed to the upper surface portions of the two middle wood pieces 15 and the center wood piece 14. The second long wood piece 23 extends over the upper surface portions of the two middle wood pieces 15 and the center wood piece 14. The second long wood piece 23 has a long rectangular plate shape, and as viewed in plan view from the upper position located above in the direction perpendicular to the bottom-plate wood pieces 11, the second long wood piece 23 is provided such that the longitudinal direction of the second long wood piece 23 is parallel to the longitudinal directions of the bottom-plate wood pieces 11 and the upper wood pieces 16. Furthermore, as viewed in plan view from the upper position located above in the direction perpendicular to the bottom-plate wood pieces 11, the second long wood piece 23 is located between the two upper wood pieces 16. The one end portion 23*a* of the second long wood piece 23 is fixed to the middle wood piece 15 located between the center wood piece 14 and the left plate wood piece 13. The other end portion 23*b* of the second long wood piece 23 protrudes from the middle wood piece 15 located between the center wood piece 14 and the left plate wood piece 13, toward the right plate wood piece 12. That is, as viewed in plan view from the upper position located above in the direction perpendicular to the bottom-plate wood pieces 11, the end portion 23*b* of the second long wood piece 23 is a free end that is located between the middle wood pieces 15 and the right plate wood piece 12. The end portion 23*b* of the second long wood piece 23 is movable in the vertical direction. The second long wood piece 23 forms part of the upper surface portion 10*b* of the support base 10 and faces the bottom plate 61 of the outdoor unit 150. As illustrated in FIG. 1, the second long wood piece 23 is provided alongside of the first long wood piece 21, and is longer than the first long wood piece 21.

(First Support Wood Piece 21*c* and Second Support Wood Piece 23*c*)

In the first long wood piece 21, the first support wood piece 21*c* is provided on the upper surface portion 21*b*1 of the end portion 21*b* on the free end portion side. The first support wood piece 21*c* is a cuboid wood piece, with which the bottom plate 61 of the outdoor unit 150 is brought into contact when the outdoor unit 150 is placed on the support base 10. Furthermore, in the second long wood piece 23, the second support wood piece 23*c* having a cuboid shape is provided on the upper surface portion 23*b*1 of the end portion 23*b* on the free end portion side. The second support wood piece 23*c* is a cuboid wood piece, with which the bottom plate 61 of the outdoor unit 150 is brought into contact when the outdoor unit 150 is placed on the support base 10. Therefore, as described above, in the longitudinal direction of each of the second long wood piece 23 and the first long wood piece 21, the second long wood piece 23 is longer than the first long wood piece 21; that is, the length of the second long wood piece 23 is greater than the length of the first long wood piece 21. Therefore, as viewed in plan view from the upper position located above in the direction perpendicular to the bottom-plate wood pieces 11, the second support wood piece 23*c* and the first support wood piece 21*c* are located between one of the middle wood pieces 15 and the right plate wood piece 12, and the second support wood piece 23*c* is closer to the right plate wood piece 12 than the first support wood piece 21*c*.

Positional relationships between the above wood pieces in the vertical direction described above are summarized as follows. In the packing unit 100, the bottom-plate wood pieces 11 are located at the lowermost layer, and the right plate wood piece 12, the left plate wood piece 13, the center wood piece 14, and the middle wood pieces 15 are each located at a higher position than the bottom-plate wood pieces 11. Also, in the packing unit 100, the upper wood pieces 16, the crossing wood piece 18, the first long wood piece 21, and the second long wood piece 23 are each located at a higher position than the right plate wood piece 12, the left plate wood piece 13, the center wood piece 14, and the middle wood pieces 15. Furthermore, in the packing unit 100, the positioning wood piece 17 is located at a higher than the upper wood pieces 16, the first support wood piece 21*c* is located at a higher position than the first long wood piece 21, and the second support wood piece 23*c* is located at a higher position than the second long wood piece 23. In addition, in the packing unit 100, the center support wood piece 21*d* is located at a higher position than the crossing wood piece 18 and the first long wood piece 21.

(Outdoor Unit 150)

As illustrated in FIG. 2, the outdoor unit 150 of the air-conditioning apparatus 200 includes the housing 51. The housing 51 of the outdoor unit 150 forms an outer shell of the outdoor unit 150. The housing 51 is made of sheet metal, and has a cuboid shape. The housing 51 includes a front panel 52 in which circular air outlets 52*a* are formed. To the front panel 52, fan guards 54 are attached. The fan guards 54 cover the air outlets 52*a* and protect propeller fans of air-sending devices 53. It should be noted that referring to FIG. 2, the outdoor unit 150 includes two air-sending devices 53, but the outdoor unit 150 may include a single air-sending device 53, or may include three or more air-sending devices 53. The outdoor unit 150 includes the leg portions 55 at the bottom plate 61 of the housing 51.

Figure 3:
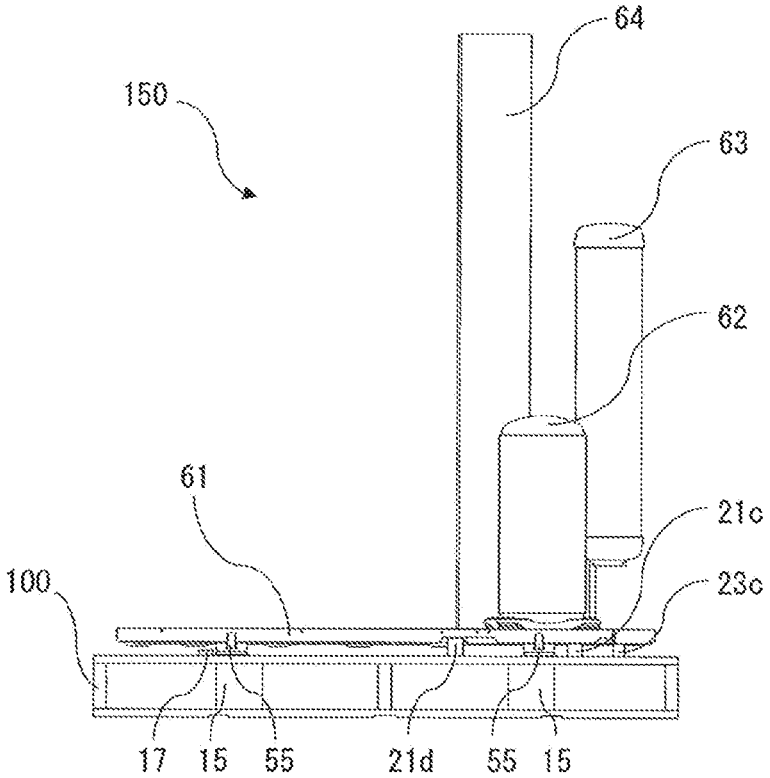
FIG. 3 is a diagram illustrating the arrangement of heavy objects in the outdoor unit, in relation to the packing unit according to Embodiment 1 of the present disclosure.
Figure 4:
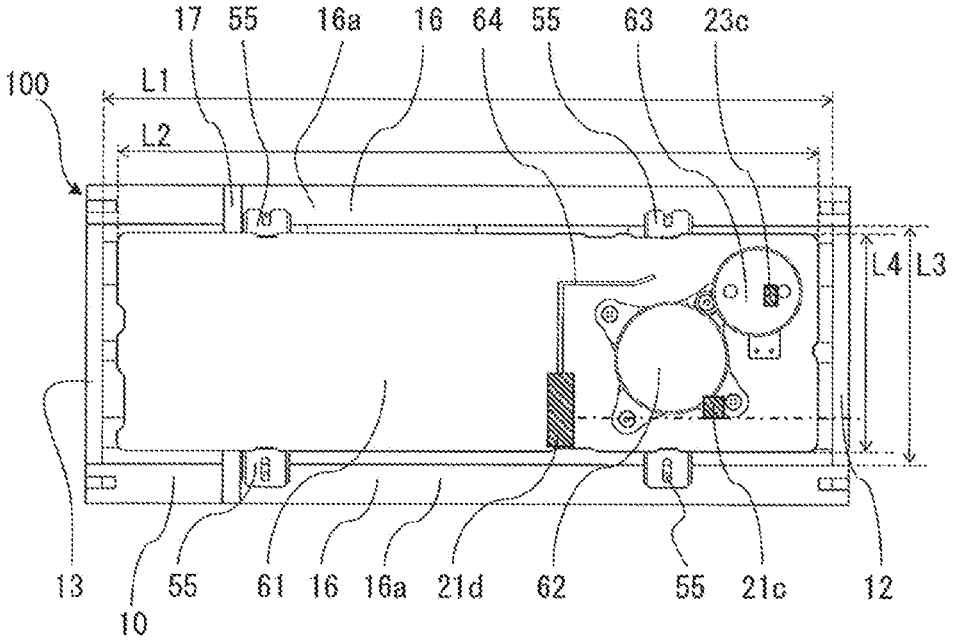
FIG. 4 is a top view illustrating a positional relationship between the packing unit according to Embodiment 1 of the present disclosure and the heavy objects in the outdoor unit.

FIG. 3 is a diagram illustrating the arrangement of heavy objects in the outdoor unit 150 in relation to the packing unit 100 according to Embodiment 1 of the present disclosure. FIG. 4 is a top view illustrating a positional relationship between the packing unit 100 according to Embodiment 1 of the present disclosure and the heavy objects in the outdoor unit 150. FIGS. 3 and 4 indicate the arrangement of heavy objects that are provided on the bottom plate 61 of the housing 51 of the outdoor unit 150. It should be noted that the heavy objects are relatively heavy components that are provided on the bottom plate 61, and are, for example, a compressor 62, an accumulator 63, and a partition 64. Furthermore, FIG. 4 also indicates positions of the first support wood piece 21*c*, the second support wood piece 23*c*, and the center support wood piece 21*d* which contact the bottom plate 61 from below. As illustrated in FIGS. 3 and 4, in the housing 51 of the outdoor unit 150, the compressor 62 and the accumulator 63 that are heavy components required to achieve a refrigeration cycle are provided on a right area of the bottom plate 61. Also, as illustrated in FIGS. 3 and 4, in the housing 51 of the outdoor unit 150, the partition 64 that is a heavy component that partitions an internal space of the housing 51 into a machine chamber and an air-sending device chamber is provided on the right area of the bottom plate 61. The center of gravity of the outdoor unit 150 is thus eccentric to be located in the right area of the outdoor unit 150.

As illustrated in FIGS. 2 and 3, the packing unit 100 is located under the outdoor unit 150 of the air-conditioning apparatus 200, and the outdoor unit 150 of the air-conditioning apparatus 200 is placed on the packing unit 100. As illustrated in FIGS. 3 and 4, the leg portions 55 of the outdoor unit 150 is in contact with the upper surface portions 16*a* of the upper wood pieces 16, and support the housing 51, on the packing unit 100. Furthermore, the bottom plate 61 of the outdoor unit 150 is in contact with each of the first support wood piece 21*c*, the second support wood piece 23*c*, and the center support wood piece 21*d* of the packing unit 100. It should be noted that when the leg portions 55 is brought into contact with a side surface portion of the positioning wood piece 17 of the packing unit 100, the outdoor unit 150 on the support base 10 is positioned.

The configuration of the packing unit 100 will be re-described with reference to FIG. 4 in relation to the relationship between the packing unit 100 and the outdoor unit 150. As illustrated in FIG. 4, the right plate wood piece 12 of the packing unit 100 is provided to extend along a right side edge of the housing 51 of the outdoor unit 150. Similarly, the left plate wood piece 13 of the packing unit 100 is provided to extend along a left side edge of the housing 51 of the outdoor unit 150. As illustrated in FIG. 4, a distance L1 between the right plate wood piece 12 and the left plate wood piece 13 is greater than a length L2 of the bottom plate 61 of the outdoor unit 150, i.e., a dimension of the bottom plate 61 in the lateral direction thereof. Furthermore, a distance L3 between the upper wood pieces 16 is greater than a width L4 of the bottom plate 61 of the outdoor unit 150, i.e., a dimension of the bottom plate 61 in a front-back direction thereof. As illustrated in FIGS. 3 and 4, the first support wood piece 21*c* of the packing unit 100 is provided such that when the outdoor unit 150 is placed on the support base 10, the first support wood piece 21*c* is located under the compressor 62. The second support wood piece 23*c* of the packing unit 100 is provided such that when the outdoor unit 150 is placed on the support base 10, the second support wood piece 23*c* is located under the accumulator 63. The center support wood piece 21*d* of the packing unit 100 is provided such that when the outdoor unit 150 is placed on the support base 10, the center support wood piece 21*d* is located under the partition 64 that partitions the inside of the housing 51 into the machine chamber and the air-sending device chamber. Furthermore, preferably, the middle wood pieces 15 of the packing unit 100 should be provided such that when the outdoor unit 150 is placed on the support base 10, the middle wood pieces 15 are located under the leg portions 55. This is because the load of the outdoor unit 150 acts on the leg portions 55, and it is therefore preferable that components that are located under the leg portions 55 have a higher strength against the load. The middle wood pieces 15 are configured to support, from below, the upper wood pieces 16 with which the leg portions 55 are brought into contact, and can increase the structural strength of the packing unit 100.

<Advantages of Packing Unit 100>

Figure 5:
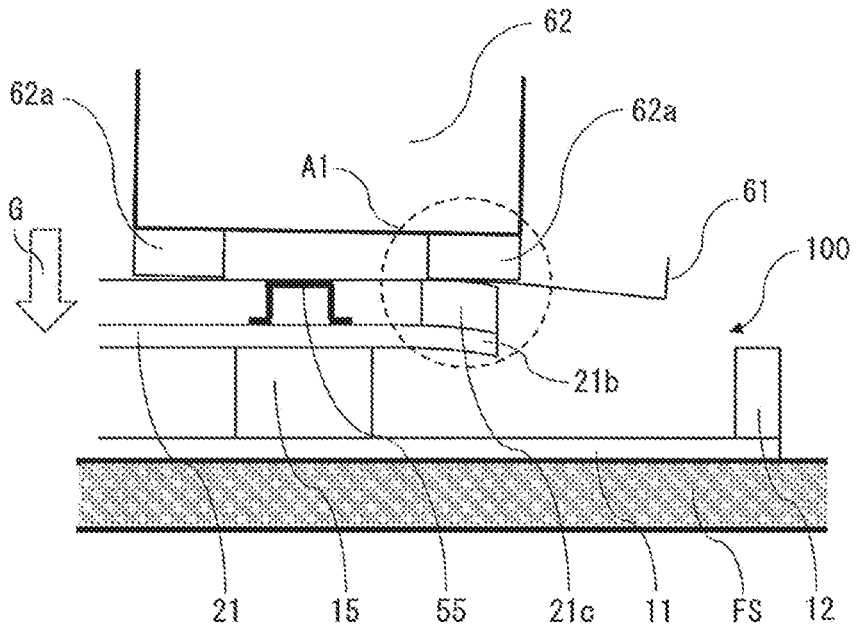
FIG. 5 is a diagram illustrating a concept of deformation of the outdoor unit that occurs when the outdoor unit vertically drops along with the packing unit according to Embodiment 1 of the present disclosure.

FIG. 5 is a diagram illustrating a concept of deformation of the outdoor unit 150 that occurs when the outdoor unit 150 vertically drops along with the packing unit 100 according to Embodiment 1 of the present disclosure. It should be noted that in the figures from FIG. 5 onward, a reference sign FS denotes a floor surface, and a reference sign G denotes a direction in which the outdoor unit 150 drops. Also, in the figures from FIG. 5 onward, illustration of the upper wood pieces 16 is omitted, in order that a relationship between the outdoor unit 150 and the packing unit 100 be clearly understood. An advantage of the packing unit 100 will be described. When the outdoor unit 150 to which the packing unit 100 is attached vertically drops on the floor surface FS, the first support wood piece 21*c* supports the load of the compressor 62, with a rubber leg 62*a* of the compressor 62 interposed between the first support wood piece 21*c* and the man body of the compressor 62, as illustrated in FIG. 5. Since the first support wood piece 21*c* supports the load of the compressor 62, a force that is applied to the bottom plate 61 can be reduced, and the bottom plate 61 can be prevented from being deformed, with the leg portion 55 acting as a support point, for example. Furthermore, the end portion 21*b* of the first long wood piece 21, on which the first support wood piece 21*c* is provided, is a free end and thus has elasticity, and the end portion 21*b* can be slightly warped, as illustrated in a broken-line area A1 in FIG. 5. Therefore, the packing unit 100 can reduce an impact that is applied to the outdoor unit 150 when the outdoor unit 150 drops.

An action equivalent to that described above also occurs between the second long wood piece 23 and the second support wood piece 23*c*, which are located below the accumulator 63. When the outdoor unit 150 to which the packing unit 100 is attached drops vertically relative to the floor surface FS, the second support wood piece 23*c* supports the load of the accumulator 63, with a support member of the accumulator 63 interposed between the second support wood piece 23*c* and the mina body of the accumulator 63. Since the second support wood piece 23*c* supports the load of the accumulator 63, a force that is applied to the bottom plate 61 can be reduced, and the bottom plate 61 can be prevented from being deformed, with the leg portion 55 acting as a support point, for example. Furthermore, the end portion 23*b* of the second long wood piece 23, on which the second support wood piece 23*c* is provided, is a free end and thus has elasticity, and the end portion 23*b* can be slightly warped as illustrated in in the broken-line area A1 in FIG. 5. Therefore, the packing unit 100 can reduce an impact that is applied to the outdoor unit 150 when the outdoor unit 150 drops.

Figure 6:
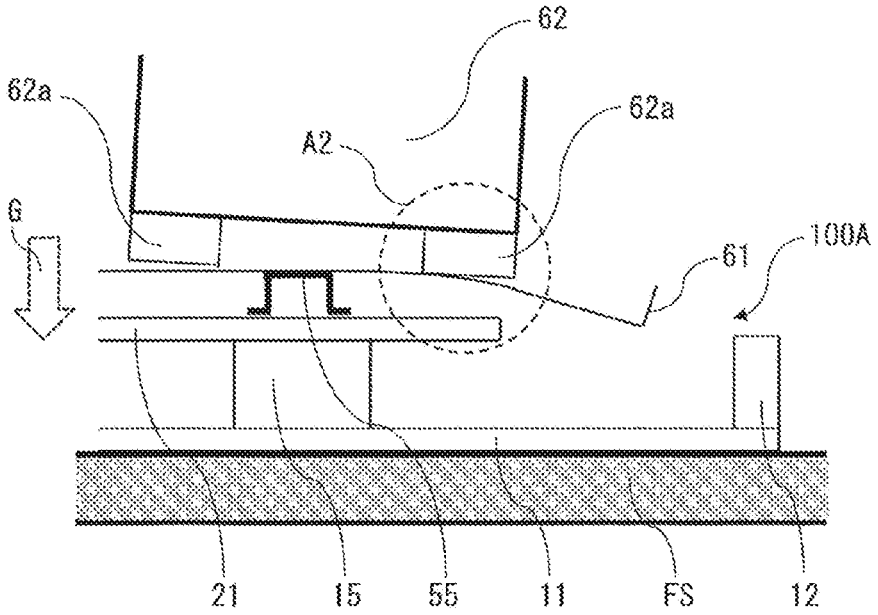
FIG. 6 is a conceptual diagram illustrating a comparative example for comparison with the packing unit as illustrated in FIG. 5.

FIG. 6 is a conceptual diagram illustrating a comparative example for comparison with the packing unit 100 as illustrated in FIG. 5. As illustrated in FIG. 6, a packing unit 100A of the comparative example is a unit not including a wood piece immediately below a heavy object in the outdoor unit 150. It will be described with reference to FIG. 6 how the outdoor unit 150 is deformed when the outdoor unit 150 vertically drops along with the packing unit 100A. As illustrated in FIG. 6, in the case where the first support wood piece 21*c* is not provided in the packing unit 100A, the compressor 62 may be inclined due to a positional relationship between the compressor 62 and the leg portion 55, and in this case, the load of the compressor 62 acts on the bottom plate 61. However, since the first support wood piece 21*c* is not provided below the bottom plate 61, the bottom plate 61 cannot support the load of the compressor 62 that acts on the bottom plate 61 through the rubber leg 62*a* of the compressor 62. Thus, the bottom plate 61 is greatly warped, as indicated in a broken-line area A2 in FIG. 6, and the bottom plate 61 is deformed.

Figure 7:
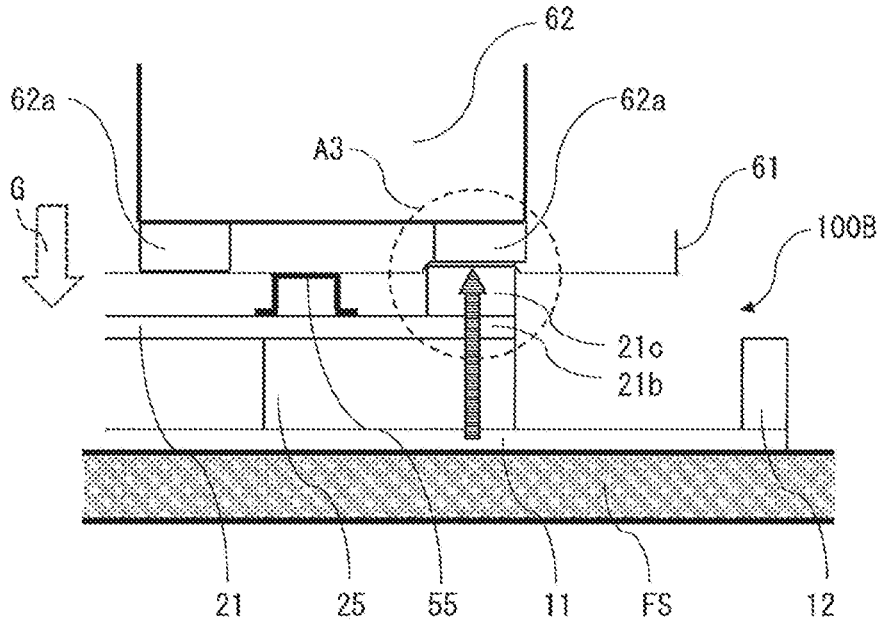
FIG. 7 is a conceptual diagram illustrating another comparative example for comparison with the packing unit as illustrated in FIG. 5.

FIG. 7 is a conceptual diagram illustrating another comparative example for comparison with the packing unit 100 as illustrated in FIG. 5. As illustrated in FIG. 7, in a packing unit 100B of the above other comparative example, the end portion 21*b* of the first long wood piece 21 is a fixed end. As illustrated in FIG. 7, in the packing unit 160E of the other comparative example, a fixing wood piece 25 is provided between the end portion 21*b* of the first long wood piece 21 and the bottom-plate wood piece 11. Therefore, the end portion 21*b* of the first long wood piece 21 employed in the packing unit 100B of the other comparative example is a fixed end, the vertical movement of which is restricted by the fixing wood piece 25. It will be described with reference to FIG. 7 how the outdoor unit 150 is deformed when the outdoor unit 150 drops along with the packing unit 100B. In the case where the end portion 21*b* of the first long wood piece 21 is held as a fixed end by the fixing wood piece 25, as illustrated in FIG. 7, an impact that is applied when the outdoor unit 150 drops is transmitted to the bottom plate 61 through the bottom-plate wood piece 11, the fixing wood piece 25, the first long wood piece 21, and the first support wood piece 21*c*. Therefore, part of the bottom plate 61 that adjoins the rubber leg 62*a* of the compressor 62 is deformed in such a manner to protrude upwardly, as illustrated in a broken-line area A3 in FIG. 7.

Figure 8:
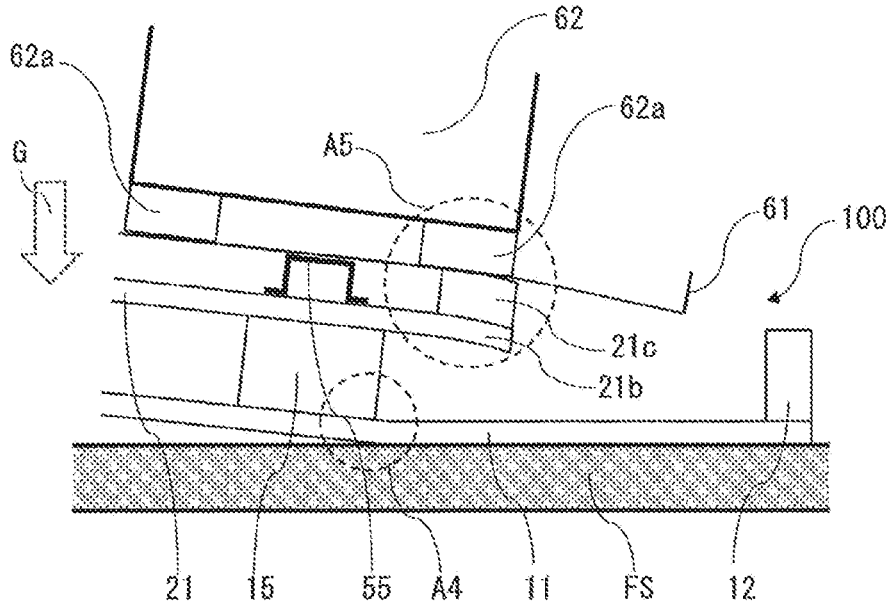
FIG. 8 is a diagram illustrating a concept of deformation of the outdoor unit that occurs when the outdoor unit drops along with the packing unit according to Embodiment 1 of the present disclosure while being inclined to the right.

FIG. 8 is a diagram illustrating a concept of deformation of the outdoor unit 150 that occurs when the outdoor unit 150 drops along with the packing unit 100 according to Embodiment 1 of the present disclosure, while being inclined to the right. As described above, in the outdoor unit 150, the heavy objects are provided on the right area of the bottom plate 61, and the center of gravity of the outdoor unit 150 is eccentric to be located in the right area of the outdoor unit 150. For example, when the outdoor unit 150 to which the packing unit 100 is attached drops while being inclined to the right relative to the floor surface FS, the bottom-plate wood pieces 11 are warped and deformed by an impact that acts on the outdoor unit 150 when the outdoor unit 150 drops, as indicated in a broken-line area A4 in FIG. 8. At this time, since the end portion 21*b* of the first long wood piece 21, on which the first support wood piece 21*c* is provided, is a free end and has elasticity, the end portion 21*b* is only slightly deformed, as indicated in a broken-line area A5 in FIG. 8. Therefore, the packing unit 100 can reduce the impact that is applied when the outdoor unit 150 drops and that is transmitted to the bottom plate 61, and thus prevent deformation of the bottom plate 61 can thus be prevented. It should be noted that in the case where the level of an impact that is applied when the outdoor unit 150 drops is at or below a threshold, even if the bottom-plate wood pieces 11 is warped and deformed, the bottom-plate wood pieces 11 are restored by the elastic force.

Figure 9:
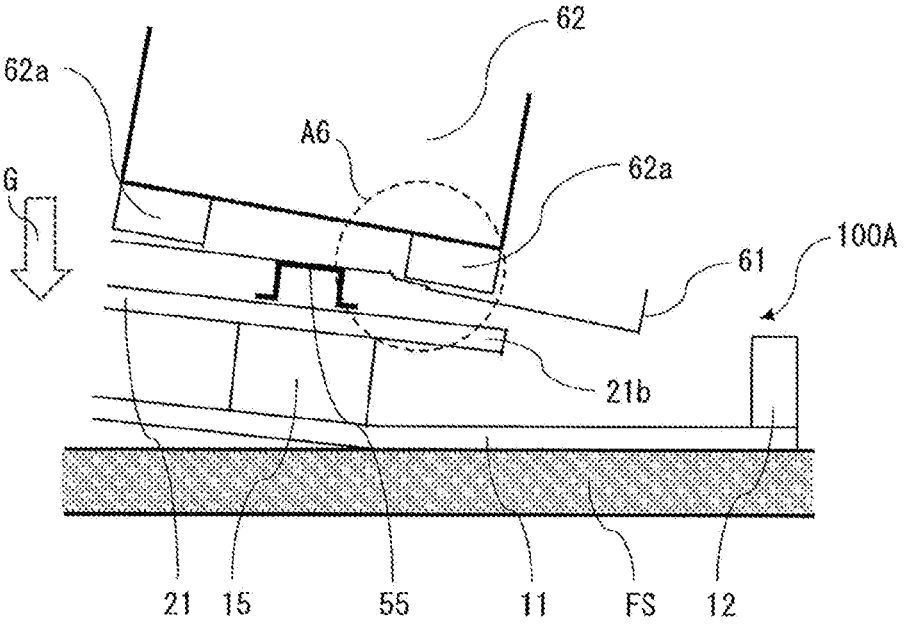
FIG. 9 is a conceptual diagram illustrating a comparative example for comparison with the packing unit as illustrated in FIG. 8.

FIG. 9 is a conceptual diagram illustrating a comparative example for comparison with the packing unit 100 as illustrated in FIG. 8. As illustrated in FIG. 9, a packing unit 100A of the comparative example is a packing unit not including a wood piece immediately below a heavy object in the outdoor unit 150. It will be described with reference to FIG. 9 how the outdoor unit 150 is deformed when the outdoor unit 150 drops along with the packing unit 100A while being inclined to the right. As illustrated in FIG. 9, in the case where the first support wood piece 21*c* is not provided in the packing unit 100A, the compressor 62 may be inclined in relation to a positional relationship between the compressor 62 and the leg portion 55, and in this case, the load of the compressor 62 is applied to the bottom plate 61. However, since the first support wood piece 21*c* is not provided below the bottom plate 61, the bottom plate 61 cannot support the load of the compressor 62 that acts on the bottom plate 61 through the rubber leg 62*a* of the compressor 62. Therefore, the bottom plate 61 is greatly warped, as indicated in a broken-line area A6 in FIG. 9, and the bottom plate 61 is deformed.

Figure 10:
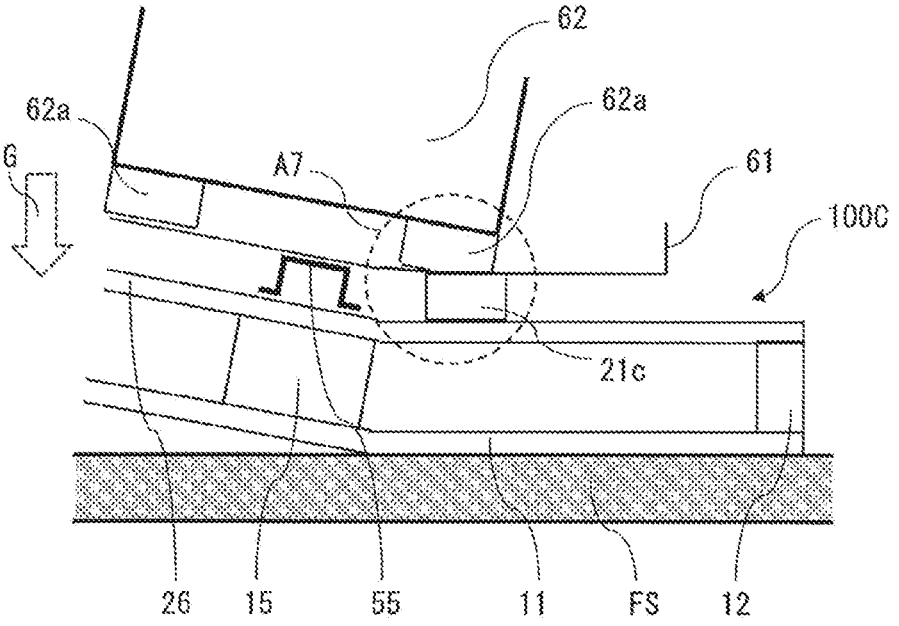
FIG. 10 is a conceptual diagram illustrating another comparative example for comparison with the packing unit as illustrated in FIG. 8.

FIG. 10 is a conceptual diagram illustrating another comparative example for comparison with the packing unit 100 as illustrated in FIG. 8. It will be described with reference to FIG. 10 how the outdoor unit 150 is deformed when the outdoor unit 150 drops along with a packing unit 1000 of the comparative example while being inclined to the right. The packing unit 1000 includes an upper wood piece 26. The upper wood piece 26 is provided to extend over the upper surface portions of the middle wood piece 15 and the right plate wood piece 12, and is fixed to the upper surface portions of the middle wood piece 15 and the right plate wood piece 12. That is, the upper wood piece 26 includes a fixed end, and does not include a free end. The first support wood piece 21*c* is provided on part of an upper surface portion of the upper wood piece 26 that is located between the middle wood piece 15 and the right plate wood piece 12. In the case where the first support wood piece 21*c* is fixed by the upper wood piece 26, as illustrated in FIG. 10, an impact that is applied when the outdoor unit 150 drops is transmitted to the upper wood piece 26 through the bottom-plate wood piece 11 and the right plate wood piece 12. Furthermore, the impact that is applied when the outdoor unit 150 drops is transmitted to the bottom plate 61 through the first support wood piece 21*c* provided on the upper surface portion of the upper wood piece 26. Therefore, the bottom plate 61 is deformed in such a manner as to be bent toward the rubber leg 62*a* of the compressor 62, as illustrated in a broken-line area A7 in FIG. 10.

As described above, the packing unit 100 includes the first long wood piece 21 that has a long plate shape, and that forms part of the upper surface portion 10*b* of the support base 10 and faces the bottom plate 61. One end portion 21*a* of the first long wood piece 21 is fixed to the support base 10 and the other end portion 21*b* of the first long wood piece 21 is formed as a free end that is movable in the vertical direction. Furthermore, the packing unit 100 includes the first support wood piece 21*c* that is provided on the upper surface portion 21*b*1 of the end portion 21*b* on a free end side of the first long wood piece 21, and that is located under a heavy object to contact the bottom plate 61 when the outdoor unit 150 is placed on the support base 10. The packing unit 100 also includes the second long wood piece 23 that has a long plate shape, and that forms part of the upper surface portion 10*b* of the support base 10 to face the bottom plate 61. The one end portion 23*a* of the second long wood piece 23 is fixed to the support base 10, and the other end portion 23*b* of the second long wood piece 23 is formed as a free end that is movable in the vertical direction. Furthermore, the packing unit 100 includes the second support wood piece 23*c* that is provided on the upper surface portion 23*b*1 of the end portion 23*b* on a free end side of the second long wood piece 23, and that is located under a heavy object to contact the bottom plate 61 when the outdoor unit 150 is placed on the support base 10. In such a manner, the packing unit 100 is formed to make use of the elastic force of wood having a higher stiffness than polystyrene foam, and supports the load of the heavy objects when the outdoor unit 150 of the air-conditioning apparatus 200 drops, and absorbs an impact that is applied when the outdoor unit 150 drops. Furthermore, the packing unit 100 has a proof stress enough to prevent the outdoor unit 150 from being broken due to the load of the outdoor unit 150 when the outdoor unit 150 drops. As a result, because of attachment of the packing unit 100 to the outdoor unit 150, an impact force that is applied from a floor when the outdoor unit 150 of the air-conditioning apparatus 200 drops to the floor is not easily transmitted to the outdoor unit 150, and an impact that is applied when the outdoor unit 150 drops is reduced, and the outdoor unit 150 can be prevented from being broken. Moreover, in the outdoor unit 150, heavy objects such as the compressor 62 and the accumulator 63 are provided on the right area of the bottom plate 61, and the center of gravity of the outdoor unit 150 is eccentric to be located in the right area of the outdoor unit 150. Thus, the outdoor unit 150 tends to drop while being inclined to the right. The packing unit 100 includes the first support wood piece 21*c* and the second support wood piece 23*c* that are located under the heavy objects to contact the bottom plate 61 when the outdoor unit 150 is placed on the support base 10. Therefore, in the packing unit 100, when the outdoor unit 150 drops while being inclined to the right, an impact that is applied when the outdoor unit 150 drops is not transmitted to the heavy objects, and deformation of the bottom plate 61 of the housing 51 can be reduced.

Furthermore, the packing unit 100 includes the support base 10 that has a framework structure made up of the bottom-plate wood pieces 11, the right plate wood piece 12, the left plate wood piece 13, the center wood piece 14, the middle wood pieces 15, and the upper wood pieces 16. Therefore, in the packing unit 100, the support base 10 itself is formed to make use of elastic force of wood having a higher stiffness than polystyrene foam, and supports the load of the heavy objects when the outdoor unit 150 of the air-conditioning apparatus 200 drops, and absorbs an impact that is applied when the outdoor unit 150 drops. Furthermore, the packing unit 100 has such a sufficient proof stress as to prevent the outdoor unit 150 being broken due to the load of the outdoor unit 150 when the outdoor unit 150 drops. As a result, because of attachment of the packing unit 100 to the outdoor unit 150 of the air-conditioning apparatus 200, an impact that is applied from a floor when the outdoor unit 150 drops to the floor is not easily transmitted to the outdoor unit 150, and the impact on the outdoor unit 150 at that time is reduced, and the outdoor unit 150 can be prevented from being broken. Furthermore, in the packing unit 100, the elastic force of the support base 10 and elastic force of the first long wood piece 21 and the second long wood piece 23 are combined. Thus, the packing unit 100 further reliably supports the load of the heavy objects that is applied when the outdoor unit 150 of the air-conditioning apparatus 200 drops, and can further reliably absorb the impact on the outdoor unit 150 at that time.

Moreover, the support base 10 further includes the positioning wood piece 17 that has a long rectangular plate shape, extends over the upper wood pieces 16, and contacts the leg portions 55 that are placed on the upper wood pieces 16, whereby the outdoor unit 150 on the support base 10 is positioned. Therefore, a worker can easily position the outdoor unit 150 when placing the outdoor unit 150 on the packing unit 100.

Furthermore, in the support base 10, the distance L1 between the right plate wood piece 12 and the left plate wood piece 13 is greater than the length L2 of the bottom plate 61, that is, the dimension of the bottom plate 61 in the lateral direction thereof, and the distance L3 between the upper wood pieces 16 is greater than the width L4 of the bottom plate 61, that is, the dimension of the bottom plate 61 in the front-back direction thereof. Therefore, even if the outdoor unit 150 of the air-conditioning apparatus 200 to which the packing unit 100 is attached drops while being inclined relative to the floor surface, the outdoor unit 150 does not crash directly into the floor surface; that is, a floor surface of an end portion of the support base 10 crashes into the floor. Furthermore, the support base 10 supports the load of the heavy objects when the outdoor unit 150 drops, and absorbs the impact on the outdoor unit 150 at that time. Furthermore, at this time, since the floor surface of the end portion of the support base 10 crashes into the floor, the floor surface side of the support base 10 may be deformed. However, a force that is applied by a collision between the support base 10 and the floor is not directly transmitted to the first support wood piece 21*c* or the second support wood piece 23*c*, these wood pieces being located at the free ends of the first long wood piece 21 and the second long wood piece 23, and the outdoor unit 150 is not easily subject to the impact that is applied when the outdoor unit 150 drops.

Furthermore, the support base 10 includes the crossing wood piece 18 that has a long rectangular plate shape, and extends over the upper surface portions of the two middle wood pieces 15 and the center wood piece 14. The support base 10 further includes the center support wood piece 21*d* that is a piece of long rectangular lumber, and extends over the upper surface portions of the first long wood piece 21 and the crossing wood piece 18. When the outdoor unit 150 is placed on the support base 10, the center support wood piece 21*d* is located under the partition 64 which is one of the heavy objects and partitions the inside of the housing 51 into the machine chamber and the air-sending device chamber, and contacts the bottom plate 61. Therefore, in the outdoor unit 150, when the outdoor unit 150 drops, the partition 64, which is one of the heavy objects, is supported from below by the center support wood piece 21*d*. As a result, the packing unit 100 can reduce deformation of the bottom plate 61 where the partition 64 is provided.

Embodiment 2

<Structure of Packing Unit 110>

Figure 11:
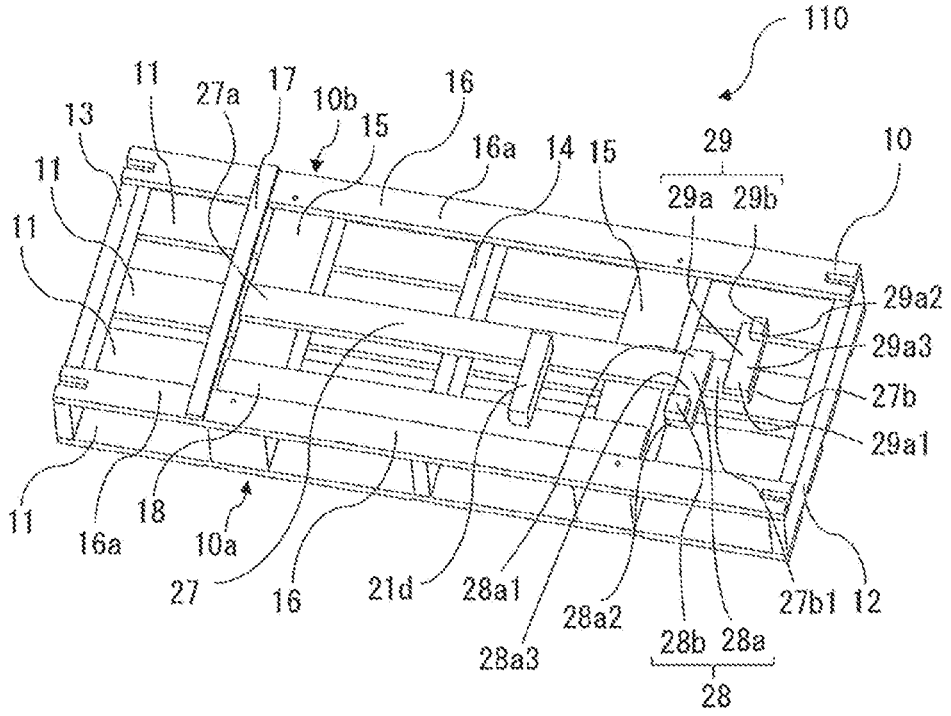
FIG. 11 is a perspective view illustrating a packing unit according to Embodiment 2 of the present disclosure.

FIG. 11 is a perspective view illustrating a packing unit 110 according to Embodiment 2 of the present disclosure. In FIG. 11, elements that are the same as those of the packing unit 100 as illustrated in FIGS. 1 to 10 are denoted by same reference signs. Thus, descriptions of the above elements will be omitted. In the following, regarding matters not particularly described regarding the packing unit 110 according to Embodiment 2, the packing unit 110 according to Embodiment 2 are the same as the packing unit 100 according to Embodiment 1, and functions and configurations of the packing unit 110 according to Embodiment 2 that are the same as those in the packing unit 110 according to Embodiment 1 are described with reference to the reference signs of elements having the above functions and the configurations that are the same as those in the packing unit 110 according to Embodiment 1.

(Third Long Wood Piece 27)

The packing unit 110 includes a third long wood piece 27 that has equivalent functions as those of the first long wood piece 21 and the second long wood piece 23 of the packing unit 100, instead of the first long wood piece 21 and the second long wood piece 23. The third long wood piece 27 is fixed to the upper surface portions of the two middle wood pieces 15 and the center wood piece 14. The third long wood piece 27 extends over the upper surface portions of the two middle wood pieces 15 and the center wood piece 14. The third long wood piece 27 has a long rectangular plate shape, and as viewed in plan view from the upper position located above in the direction perpendicular to the bottom-plate wood pieces 11, the third long wood piece 27 is provided such that the longitudinal direction of the third long wood piece 27 is parallel to the longitudinal directions of the bottom-plate wood pieces 11 and the upper wood pieces 16. Furthermore, as viewed in plan view from the upper position located above in the direction perpendicular to the bottom-plate wood pieces 11, the third long wood piece 27 is provided between the two upper wood pieces 16. One end portion 27*a* of the third long wood piece 27 is fixed to the middle wood piece 15 provided between the center wood piece 14 and the left plate wood piece 13. The other end portion 27*b* of the third long wood piece 27 protrudes from the location of the middle wood piece 15 provided between the center wood piece 14 and the left plate wood piece 13, toward the right plate wood piece 12. That is, as viewed in plan view from the upper position located above in the direction perpendicular to the bottom-plate wood pieces 11, the end portion 27*b* of the third long wood piece 27 is a free end that is located between the middle wood pieces 15 and the right plate wood piece 12. The end portion 27*b* of the third long wood piece 27 is movable in the vertical direction. The third long wood piece 27 forms part of the upper surface portion 10*b* of the support base 10 and faces the bottom plate 61 of the outdoor unit 150.

The center support wood piece 21*d* is fixed to upper surface portions of the third long wood piece 27 and the crossing wood piece 18. The center support wood piece 21*d* extends over the upper surface portions of the third long wood piece 27 and the crossing wood piece 18. The center support wood piece 21*d* is a piece of long rectangular lumber, and as viewed in plan view from the upper position located above in the direction perpendicular to the bottom-plate wood pieces 11, the center support wood piece 21*d* is provided such that the longitudinal direction of the center support wood piece 21*d* is parallel to the longitudinal directions of the right plate wood piece 12, the left plate wood piece 13, the center wood piece 14, and the middle wood pieces 15. When the outdoor unit 150 is placed on the packing unit 110, the center support wood piece 21*d* contacts the bottom plate 61 of the outdoor unit 150. When the outdoor unit 150 is placed on the support base 10, the center support wood piece 21*d* is located under the partition 64.

(Third Support Wood Piece 28 and Fourth Support Wood Piece 29)

The packing unit 110 includes a third support wood piece 28 and a fourth support wood piece 29 that are provided on an upper surface portion 27*b*1 of the end portion 27*b* on a free end side of the third long wood piece 27, and that are located under heavy objects and contact the bottom plate 61 when the outdoor unit 150 is placed on the support base 10. The third support wood piece 28 and the fourth support wood piece 29 are provided to extend in a direction perpendicular to that of the third long wood piece 27. Furthermore, the third support wood piece 28 and the fourth support wood piece 29 are arranged in the longitudinal direction of the third long wood piece 27, and the third support wood piece 28 is provided close to the left plate wood piece 13, and the fourth support wood piece 29 is provided on a side closer to the right plate wood piece 12.

The third support wood piece 28 includes a first protruding wood piece 28*a*. One end portion 28*a*1 of the first protruding wood piece 28*a* in the width direction of the third long wood piece 27 is fixed to the upper surface portion

27*b*1 of the end portion 27*b* on a free end side of the third long wood piece 27, and the other end portion 28*a*2 of the first protruding wood piece 8*a* in the width direction of the third long wood piece 27 is a free end that protrudes from the location of the third long wood piece 27. Therefore, the width direction of the third long wood piece 27 is a direction perpendicular to the longitudinal direction of the third long wood piece 27 as viewed in plan view from the upper position located above in the direction perpendicular to the bottom-plate wood pieces 11. The first protruding wood piece 28*a* has a plate shape. The first protruding wood piece 28*a* protrudes on a side where the center support wood piece 21*d* is provided, and the end portion 28*a*2 of the first protruding wood piece 28*a* in the protruding direction thereof is a free end. That is, the end portion 28*a*2 of the first protruding wood piece 28*a* is a free end extending in a direction where the front side of the housing 51 faces.

The third support wood piece 28 further includes a first base wood piece 28*b* that is provided on an upper surface portion 28*a*3 of the end portion 28*a*2 on a free end side of the first protruding wood piece 28*a*, and that is located under the compressor 62, which is one of the heavy objects, when the outdoor unit 150 is placed on the support base 10. The first base wood piece 28*b* is a cuboid wood piece, and when the outdoor unit 150 is placed on the support base 10, the bottom plate 61 of the outdoor unit 150 is brought into contact with the first base wood piece 28*b*.

The fourth support wood piece 29 includes a second protruding wood piece 29*a*. One end portion 29*a*1 of the second protruding wood piece 29*a* in the width direction of the third long wood piece 27 is fixed to the upper surface portion 27*b*1 of the end portion 27*b* on the free end side of the third long wood piece 27, and the other end portion 29*a*2 of the second protruding wood piece 29*a* is a free end that protrudes from the third long wood piece 27. The second protruding wood piece 29*a* protrudes in the opposite direction to the protruding direction of the first protruding wood piece 28*a*. The second protruding wood piece 29*a* has a plate shape. The second protruding wood piece 29*a* protrudes on the opposite side of the side where the center support wood piece 21*d* is provided, and the end portion 29*a*2 of the second protruding wood piece 29*a* in the protruding direction thereof is a free end. That is, the end portion 29*a*2 of the second protruding wood piece 29*a* is a free end that extends in a direction where the back side of the housing 51 faces.

The first protruding wood piece 28*a* and the second protruding wood piece 29*a* protrude, respectively, toward the upper wood pieces 16 that are provided on front and rear portions of the support base 10. At the end portion 27*b* on the free end side of the third long wood piece 27, the second protruding wood piece 29*a* is located closer to a distal end side of the third long wood piece 27 than the first protruding wood piece 28*a*, and the first protruding wood piece 28*a* is located closer to a fixed side of the third long wood piece 27 than the second protruding wood piece 29*a*.

The fourth support wood piece 29 further includes a second base wood piece 29*b* that is provided on an upper surface portion 29*a*3 of the end portion 29*a*2 on a free end side of the second protruding wood piece 29*a*, and that is located under the accumulator 63, which is one of the heavy objects, when the outdoor unit 150 is placed on the support base 10. The second base wood piece 29*b* is a cuboid wood piece, and when the outdoor unit 150 is placed on the support base 10, the bottom plate 61 of the outdoor unit 150 is brought into contact with the second base wood piece 29*b*. It should be noted that as described above, with regard to the first protruding wood piece 28*a* and the second protruding wood piece 29*a*, at the end portion 27*b* on the free end side of the third long wood piece 27, the second protruding wood piece 29*a* is positioned closer to the distal end side of the third long wood piece 27 than the first protruding wood piece 28*a*, and the first protruding wood piece 28*a* is located close to the fixed side of the third long wood piece 27 than the second protruding wood piece 29*a*. Therefore, as viewed in plan view from the upper position located above in the direction perpendicular to the bottom-plate wood pieces 11, the second base wood piece 29*b* is provided at a position, between the middle wood piece 15 and the right plate wood piece 12, which is closer to the right plate wood piece 12 than the first base wood piece 28*b*.

The above positional relationships between the wood pieces in the packing unit 110 is summarized as follows; in the packing unit 110, the bottom-plate wood pieces 11 are provided in a lowermost layer; the right plate wood piece 12, the left plate wood piece 13, the center wood piece 14, and the middle wood pieces 15 are provided at positions higher than the bottom-plate wood pieces 11; the upper wood pieces 16, the crossing wood piece 18, and the third long wood piece 27 are provided at positions higher than the right plate wood piece 12, the left plate wood piece 13, the center wood piece 14, and the middle wood pieces 15; the positioning wood piece 17 is provided at a position higher than the upper wood pieces 16, the first protruding wood piece 28*a* and the second protruding wood piece 29*a* are provided at positions higher than the third long wood piece 27, and the center support wood piece 21*d* is provided at a position higher than the crossing wood piece 18 and the third long wood piece 27; and the first base wood piece 28*b* is provided at a position higher than the first protruding wood piece 28*a*, and the second base wood piece 29*b* is provided at a position higher than the second protruding wood piece 29*a*.

As described above, the packing unit 110 includes the third long wood piece 27 that has a long plate shape, and that forms part of the upper surface portion 10*b* of the support base 10 and faces the bottom plate 61. The one end portion 27*a* of the third long wood piece 27 is fixed to the support base 10, and the other end portion 27*b* of the third long wood piece 27 is formed as a free end that is movable in the vertical direction. Furthermore, the packing unit 110 includes the third support wood piece 28 and the fourth support wood piece 29 that are provided on the upper surface portion 27*b*1 of the end portion 27*b* on the free end side of the third long wood piece 27, and that are located under heavy objects and contact the bottom plate 61 when the outdoor unit 150 is placed on the support base 10. Therefore, the packing unit 110 is formed to make use of elastic force of wood having a higher stiffness than polystyrene foam, and supports the load of the heavy objects when the outdoor unit 150 of the air-conditioning apparatus 200 drops, and absorbs the impact on the outdoor unit 150 at that time. Furthermore, the packing unit 110 has a proof stress enough to prevent the outdoor unit 150 from being broken due to the load of the outdoor unit 150 that acts when the outdoor unit 150 drops. As a result, because of attachment of the packing unit 110 to the outdoor unit 150 of the air-conditioning apparatus 200, an impact that is applied from a floor when the outdoor unit 150 drops to the floor is not easily transmitted to the outdoor unit 150, and an impact on the outdoor unit 150 at that time is reduced, and the outdoor unit 150 can be prevented from being broken. Moreover, in the outdoor unit 150, the heavy objects, for example, the compressor 62 and the accumulator 63, are provided on the right area of the bottom plate 61, and the center of gravity of the outdoor unit 150 is eccentric to be located in the right area of the outdoor unit 150. Therefore, the outdoor unit 150 tends to drop while being inclined to the right. The packing unit 110 includes the third support wood piece 28 and the fourth support wood piece 29 that are located under the heavy objects and contact the bottom plate 61 when the outdoor unit 150 is placed on the support base 10. Thus, in the packing unit 110, when the outdoor unit 150 drops while being inclined to the right, an impact that is applied at that time is not transmitted to the heavy objects, and deformation of the bottom plate 61 of the housing 51 can be reduced. Moreover, since the third long wood piece 27 is made to have both the functions of the first long wood piece 21 and the second long wood piece 23 of Embodiment 1, it is possible to reduce the total quantity of wood pieces required to form the packing unit 110. Furthermore, the third support wood piece 28 includes the first protruding wood piece 28*a* that is formed to have a plate shape such that the one end portion 28*a*1 of the first protruding wood piece 28*a* is fixed and the other end portion 28*a*2 of the first protruding wood piece 28*a* is a free end. Similarly, the fourth support wood piece 29 includes the second protruding wood piece 29*a* that is formed to have a plate shape such that the one end portion 29*a*1 of the second protruding wood piece 29*a* is fixed and the other end portion 29*a*2 of the second protruding wood piece 29*a* is a free end. The packing unit 110 can further make use of elastic force of the wood pieces by using the first protruding wood piece 28*a* and the second protruding wood piece 29*a*, and support the load of the heavy objects and absorb an impact that is applied when of the outdoor unit 150 of the air-conditioning apparatus 200 drops. Furthermore, in the packing unit 110, with respect to the arrangement of the heavy objects, the positions of the objects can be easily changed by changing the positions of the first protruding wood piece 28*a* and the second protruding wood piece 29*a*.

Embodiments of the present disclosure are not limited to Embodiments 1 and 2 described above. For example, although the first support wood piece 21*c* and the second support wood piece 23*c* are cuboid wood pieces, the first support wood piece 21*c* and the second support wood piece 23*c* may be formed to have other shapes such as a hemispherical shape, a circular columnar shape, and a polygonal columnar shape, as long as the first support wood piece 21*c* and the second support wood piece 23*c* are formed to support the heavy objects provided on the bottom plate 61. Similarly, although the first base wood piece 28*b* and the second base wood piece 29*b* are cuboid wood pieces, the first base wood piece 28*b* and the second base wood piece 29*b* may be formed to have other shapes such as a hemispherical shape, a circular columnar shape, and a polygonal columnar shape, as long as the first base wood piece 28*b* and the second base wood piece 29*b* are formed to support the heavy objects.

REFERENCE SIGNS LIST

10 support base 10*a* bottom portion 10*b* upper surface portion 11 bottom-plate wood piece 11*an* upper surface portion 12 right plate wood piece

13 left plate wood piece 14 center wood piece 15 middle wood piece

16 upper wood piece 16*an* upper surface portion 17 positioning wood piece 18 crossing wood piece 21 first long wood piece 21*a* end portion

21*b* end portion 21*b*1 upper surface portion 21*c* first support wood piece 21*d* center support wood piece 23 second long wood piece 23*a* end portion 23*b* end portion 23*b*1 upper surface portion 23*c* second support wood piece 25 fixing wood piece 26 upper wood piece 27 third long wood piece 27*a* end portion 27*b* end portion 27*b*1 upper surface portion 28 third support wood piece 28*a* first protruding wood piece

28*a*1 end portion 28*a*2 end portion 28*a*3 upper surface portion 28*b* first base wood piece 29 fourth support wood piece 29*a* second protruding wood piece 29*a*1 end portion 29*a*2 end portion 29*a*3 upper surface portion 29*b* second base wood piece 51 housing 52 front panel

52*a* air outlet 53 air-sending device 54 fan guard 55 leg portion

61 bottom plate 62 compressor 62*a* rubber leg 63 accumulator 64 partition 100 packing unit 100A packing unit 100B packing unit

100C packing unit 110 packing unit 150 outdoor unit 200 air-conditioning apparatus

The invention claimed is:

1. A packing unit for an air-conditioning apparatus provided with an outdoor unit including heavy objects that are provided on a bottom plate of a housing of the outdoor unit, the packing unit being provided as a unit on which the outdoor unit is placed, the packing unit comprising:

a support base having a cuboid framework structure made by combining a plurality of wood pieces, the support base being configured to support the outdoor unit when the outdoor unit is placed on the support base;

a long wood piece that has a long plate shape, and that forms part of an upper surface portion of the support base and faces the bottom plate, the long wood piece having end portions, one of the end portions being fixed to the support base, the other being a free end that is movable in a vertical direction; and a support wood piece that is provided on an upper surface portion of the end portion on a free end side of the long wood piece, and that is located under the heavy objects and contact the bottom plate when the outdoor unit is placed on the support base.

2. The packing unit for an air-conditioning apparatus of claim 1, wherein the support base includes a plurality of bottom-plate wood pieces each having a long rectangular plate shape, the plurality of bottom-plate wood pieces being located parallel to each other in the same plane, a right plate wood piece and a left plate wood piece each provided as a piece of long rectangular lumber, the right plate wood piece and the left plate wood piece being fixed to upper surface portions of the plurality of bottom-plate wood pieces, at respective end portions of each of the plurality of bottom-plate wood pieces in a longitudinal direction of each bottom-plate wood piece, a center wood piece that is a piece of long rectangular lumber, the center wood piece being provided on the upper surface portions of the plurality of bottom-plate wood pieces, between the right plate wood piece and the left plate wood piece, middle wood pieces each provided as a piece of long rectangular lumber, the middle wood pieces being located on the upper surface portions of the plurality of bottom-plate wood pieces, one of the middle wood pieces being located between the right plate wood piece and the center wood piece and the other being located between the left plate wood piece and the center wood piece, and upper wood pieces that are provided on upper surface portions of the right plate wood piece, the left plate wood piece, the center wood piece, and the middle wood pieces in such a manner as to face the bottom-plate wood pieces, at respective end portions of each of the right plate wood piece, the left plate wood piece, the center wood piece, and the middle wood pieces in a longitudinal direction of each of the right plate wood piece, the left plate wood piece, the center wood piece, and the middle wood pieces, the upper wood pieces being provided as pieces on which leg portions provided on the bottom plate are placed on.

3. The packing unit for an air-conditioning apparatus of claim 2, wherein the support base further includes a positioning wood piece that has a long rectangular plate shape, that extends between the upper wood pieces, and that positions the outdoor unit on the support base when contacting the leg portions placed on the upper wood pieces.

4. The packing unit for an air-conditioning apparatus of claim 2, wherein in the support base, a distance between the right plate wood piece and the left plate wood piece is greater than a length of the bottom plate in a lateral direction thereof, and a distance between the upper wood pieces is greater than a width of the bottom plate in a front-back direction thereof.

5. The packing unit for an air-conditioning apparatus of claim 2, wherein the support base further includes a crossing wood piece that has a long rectangular plate shape, and that extends over the upper surface portions of the two middle wood pieces and the center wood piece, and a center support wood piece that is a piece of long rectangular lumber, that extends over upper surface portions of the long wood piece and the crossing wood piece, and that is located under a partition and contacts the bottom plate when the outdoor unit is placed on the support base, the partition being one of the heavy objects and partitioning an inside of the housing into a machine chamber and an air-sending device chamber.

6. The packing unit for an air-conditioning apparatus of claim 2, wherein the long wood piece includes a first long wood piece and a second long wood piece that is located parallel to the first long wood piece and that is longer than the first long wood piece, the first long wood piece and the second long wood piece are provided on the upper surface portions of the center wood piece and the middle wood pieces, between the upper wood pieces, the support wood piece includes a first support wood piece that is provided on the first long wood piece, and a second support wood piece that is provided on the second long wood piece, and when the outdoor unit is placed on the support base, the first support wood piece is located under a compressor that is one of the heavy objects, and the second support wood piece is located under an accumulator that is another one of the heavy objects.

7. The packing unit for an air-conditioning apparatus of claim 2, wherein the long wood piece is provided on the upper surface portions of the center wood piece and the middle wood pieces, between the upper wood pieces, the support wood piece includes a third support wood piece and a fourth support wood piece that are arranged in a longitudinal direction of the long wood piece, the third support wood piece includes a first protruding wood piece that has a plate shape, one of end portions of the first protruding wood piece in a width direction of the long wood piece being fixed to the upper surface portion of the end portion on the free end side of the long wood piece, the other end portion of the first protruding wood piece being a free end protruding from the long wood piece, and a first base wood piece that is provided on an upper surface portion of the end portion on a free end side of the first protruding wood piece, and that is located under a compressor that is one of the heavy objects when the outdoor unit is placed on the support base, and the fourth support wood piece includes a second protruding wood piece that has a plate shape, one of end portions of the second protruding wood piece in the width direction of the long wood piece being fixed to the upper surface portion of the end portion on the free end side of the long wood piece, and the other end portion being a free end protruding from the long wood piece in an opposite direction to a protruding direction of the first protruding wood piece, and a second base wood piece that is provided on an upper surface portion of the end portion on a free end side of the second protruding wood piece, and that is located under an accumulator that is another one of the heavy objects when the outdoor unit is placed on the support base.

* * * * *